US005832647A

United States Patent [19]

Ling et al.

[11] Patent Number: 5,832,647

[45] Date of Patent: Nov. 10, 1998

[54] ERGONOMICALLY UNLOCKABLE FIREARM LOCK

[76] Inventors: Chong-Kuan Ling; Chun-Shen Wu, both of c/o Sinox Co., Ltd. P. O. Box 96-156, Taipei, Taiwan

[21] Appl. No.: 949,956

[22] Filed: Oct. 14, 1997

[51] Int. Cl.[6] ..... F41A 17/54

[52] U.S. Cl. ..... 42/70.07; 42/70.11

[58] Field of Search ..... 42/70.07, 70.11

[56] References Cited

U.S. PATENT DOCUMENTS

| | | | |
|---|---|---|---|
| 5,419,068 | 5/1995 | Pages et al. | 42/70.07 |
| 5,638,627 | 6/1997 | Klein et al. | 42/70.07 |
| 5,647,158 | 7/1997 | Eskelinen et al. | 42/70.07 |

*Primary Examiner*—Charles T. Jordan
*Assistant Examiner*—Chris J. Brown

[57] ABSTRACT

A firearm lock includes: a male fastening member having a latch portion extending therefrom, a control device having a biasing button and securable to the male fastening member and a locking mechanism provided in the male fastening member for locking or unlocking the control device; and a female fastening member engageable with the male fastening member to be disposed on opposite sides of a trigger guard of a firearm; the male fastening member having the latch portion rotatably securable in the male fastening member to be engageable with a ratchet catch resiliently mounted in the female fastening member, and the control device controlling the engagement or disengagement of the latch portion with or from the ratchet catch; whereby upon a biasing movement of the biasing button of the control device to disengage the latch portion from the ratchet catch when the locking mechanism is unlocked, the male fastening member will be ergonomically unlocked and separated from the female fastening member without continuously holding (depressing) the biasing button of the control device.

5 Claims, 5 Drawing Sheets

1
212
211
21
2
11
213
214
12
231
232
23
233
234
172
17
171
15
161
16
18
181
182
512
51
511
5
532
53
531
50
521
52

FIG. 7
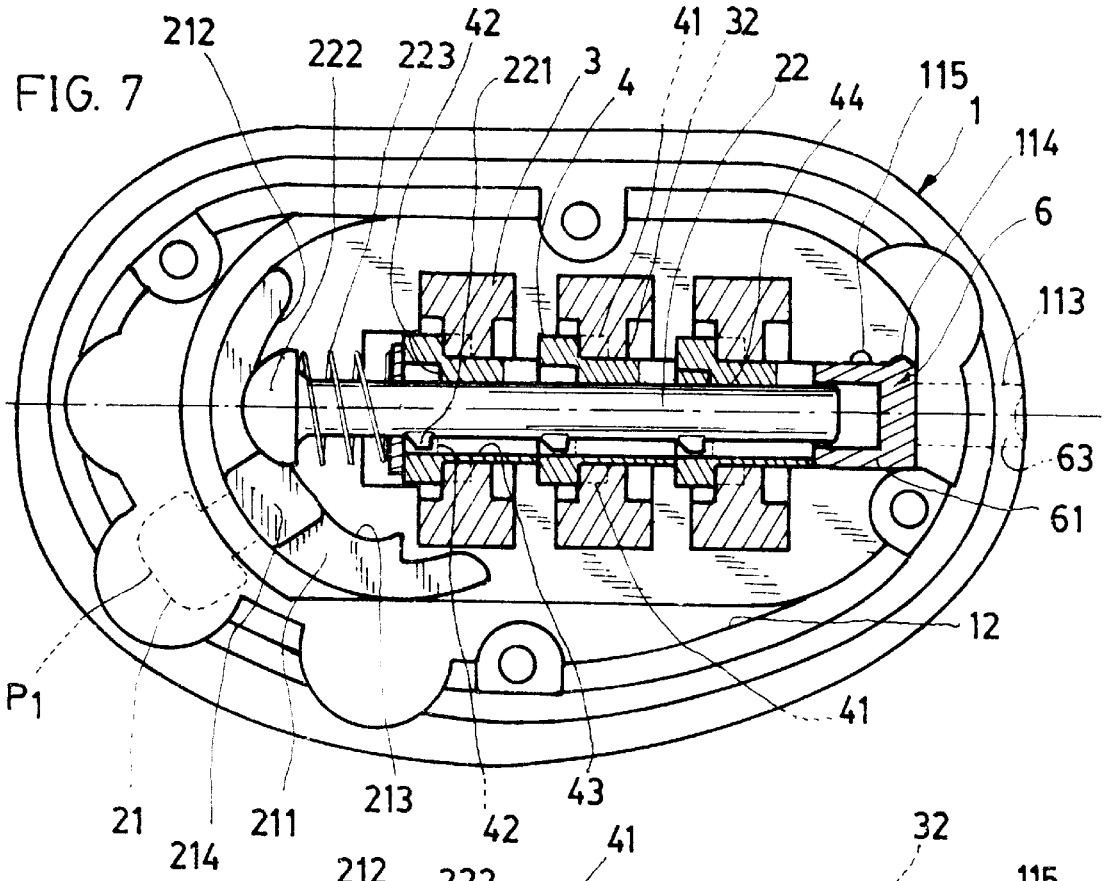
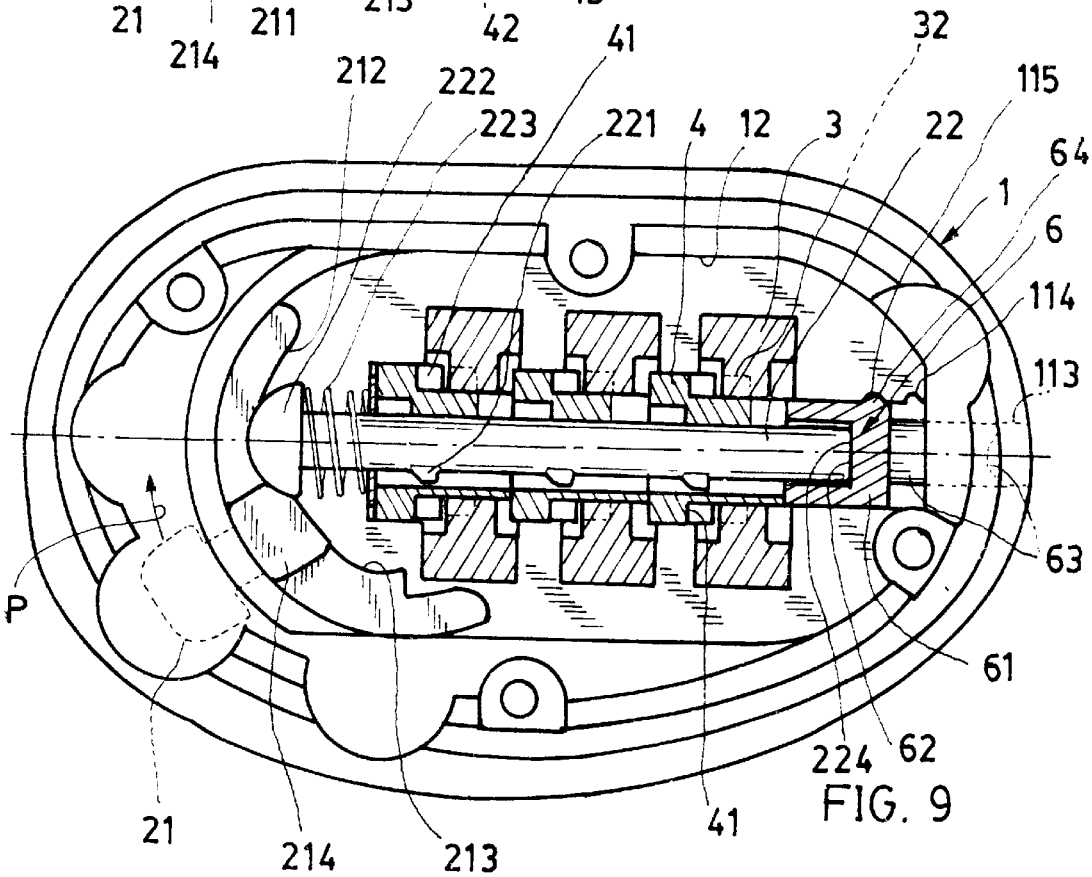
FIG. 9

ERGONOMICALLY UNLOCKABLE FIREARM LOCK

BACKGROUND OF THE INVENTION

U.S. Pat. No. 4,499,681 to Lazlo Bako disclosed a security device for a firearm comprising a pair of covers adapted to be disposed on opposite sides of a firearm trigger guard, whereby upon mutual engagement of the two covers to embrace the trigger guard, the trigger of the firearm can be prevented for operation.

However, when unlocking the two covers of the Bako's device, the push button 36 of the manual actuator should be continuously depressed to disengage the teeth 30 of the elongate latching portion 54 securable to the push button 36 from the ratchet teeth 26 of the catch member 24, causing inconvenience for the firearm owner. The inconvenient unlocking operation of the Bako's firearm lock may delay the response time to use the firearm such as for self defense purpose in case of emergency, thereby influencing the effect of the firearm.

The present inventors have found the drawbacks of the conventional firearm lock and invented the present firearm lock which can be ergonomically unlockable.

SUMMARY OF THE INVENTION

The object of the present invention is to provide a firearm lock including: a male fastening member having a latch portion extending therefrom, a control device having a biasing button and securable to the male fastening member and a locking mechanism provided in the male fastening member for locking or unlocking the control device; and a female fastening member engageable with the male fastening member to be disposed on opposite sides of a trigger guard of a firearm; the male fastening member having the latch portion rotatably securable in the male fastening member to be engageable with a ratchet catch resiliently mounted in the female fastening member, and the control device controlling the engagement or disengagement of the latch portion with or from the ratchet catch; whereby upon a biasing movement of the biasing button of the control device to disengage the latch portion from the ratchet catch when the locking mechanism is unlocked, the male fastening member will be ergonomically unlocked and separated from the female fastening member without continuously holding (depressing) the biasing button of the control device.

BRIEF DESCRIPTION OF THE DRAWINGS

FIG. 7 is a sectional drawing of the present invention showing a conversion from a locking state to an unlockable state.

FIG. 9 is an illustration of the present invention for changing a locking/unlocking combination.

DETAILED DESCRIPTION

Figure 6:
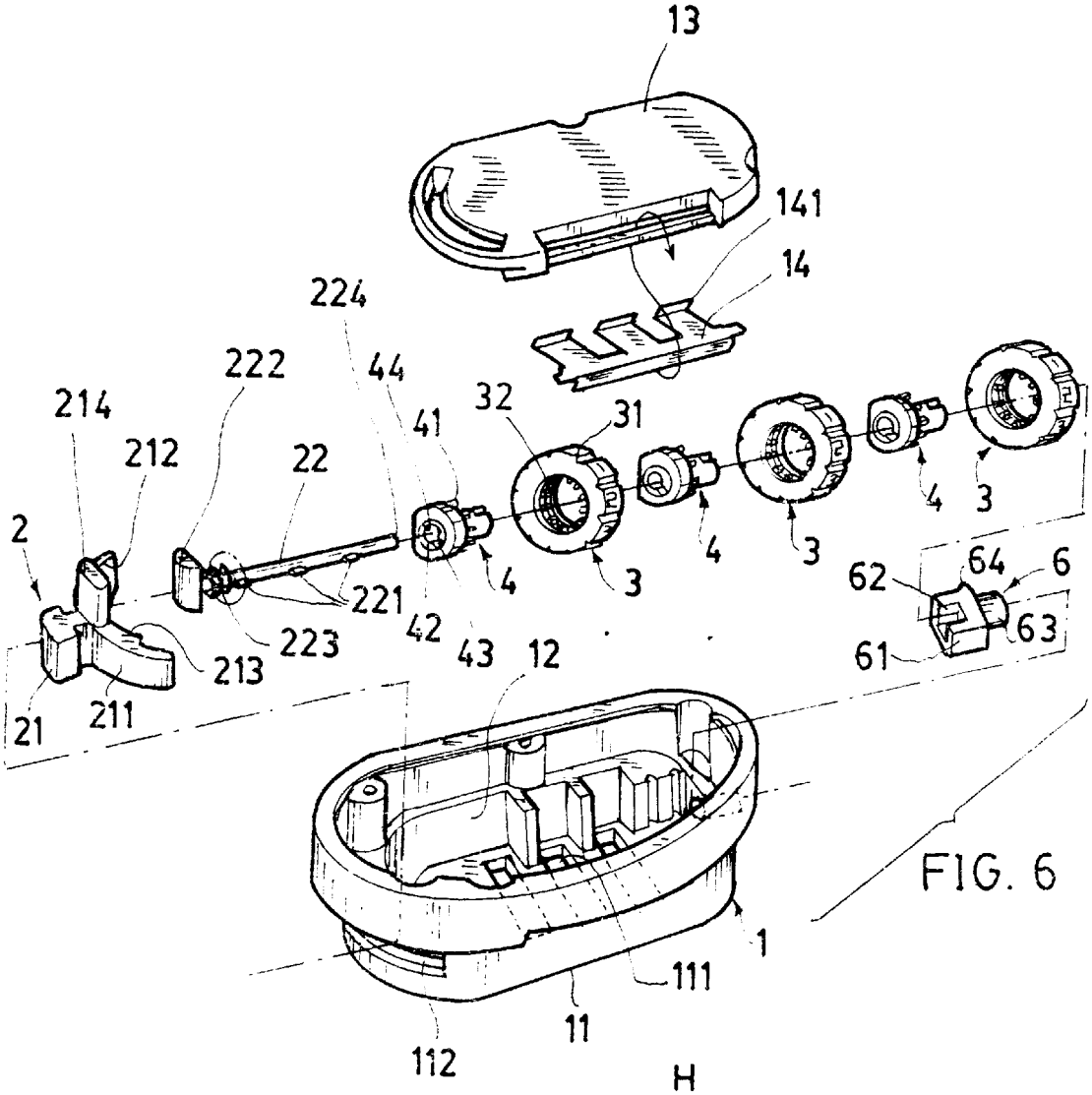
FIG. 6 is an exploded view of a male fastening member of the present invention.
Figure 1:
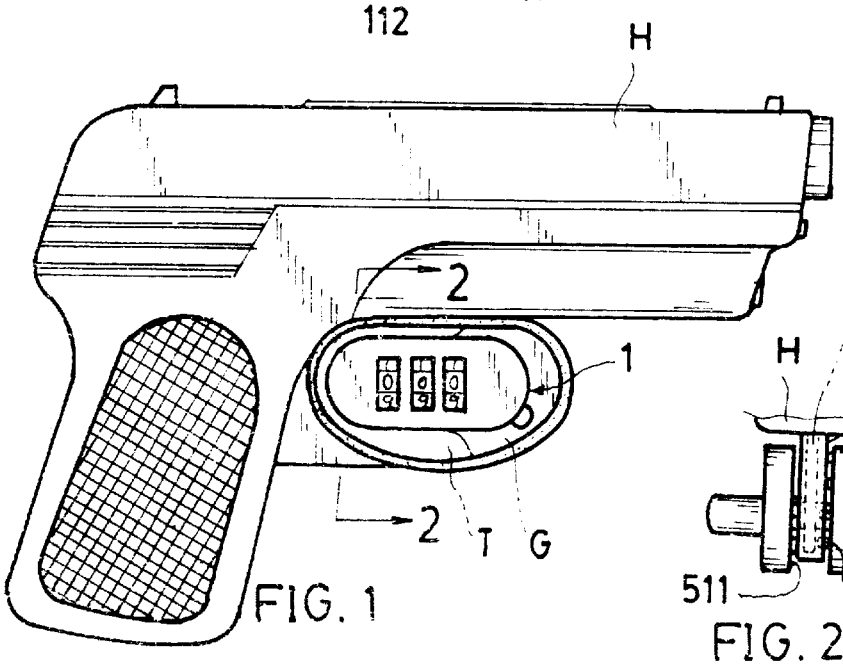
FIG. 1 is an illustration showing the present invention for locking a firearm trigger.
Figure 2:
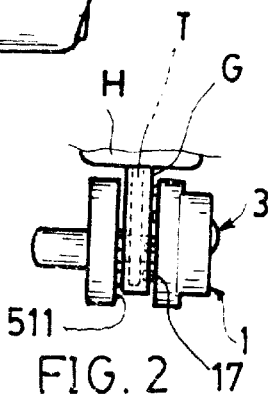
FIG. 2 is a side view from 2—2 direction of FIG. 1.

As shown in the drawing figures, the present invention comprises: a male fastening member 1, a control device 2, a locking mechanism of which a preferred embodiment of combination lock includes a plurality of dials 3 and sleeves 4 provided in the male fastening member for locking or unlocking the control device 2, a female fastening member 5 combinable and engageable with the male fastening member 1 to be disposed on opposite sides of a trigger guard G of a firearm such as a handgun H for clamping, embracing and locking the trigger T and the trigger guard G of the firearm H, and a combination changing means 6 mounted in the male fastening member 1 for changing or re-setting a new combination of the locking mechanism when designed as a combination lock.

Other locking mechanisms such as a key operated locking mechanism, card actuated locking system and so on, may be selected and modified to be used in the present invention.

The male fastening member 1 includes: a male cover 11 having a recess chamber 12 formed in the male cover 11 for providing partial elements of the control device 2, the dials 3 and the sleeves 4 in the recess chamber 12 with the dials 3 protruding outwardly through a plurality of slots 111 formed in the cover 11 for dialing use, a diaphragm plate 13 for confining the dials 3 and sleeves 4 within the recess chamber 12, a sensing plate 14 backed by the diaphragm plate 13 and having a plurality of resilient angled portions 141 resiliently contacting the dials 3 for sensing the dialing feeling when rotating the dials 3 for locking or unlocking the present invention, a holding base 15 sealing a bottom portion of the male cover 11 and having a latch guide 16 protruding from the base 15 for inserting a latch portion 23 of the control device 2 within the latch guide 16 having an elongate opening 161 for revealing ratchet teeth 233 of the latch portion 23 outwardly through the elongate opening 161, a plurality of beads 17 respectively resiliently held in a plurality of cylinders 171 formed on the base 15 by a plurality of tension springs 172, and a bottom packing 18 secured on a bottom surface of the base 15 having a guide hole 181 for passing the latch guide 16 and plural cylinder holes 182 for passing and protruding the beads 17 outwardly beyond the cylinders 171. The bottom packing 18 may be made of rubber material.

The control device 2 includes: a biasing button 21 slidably held in a button hole 112 formed in the male cover 11 of the male fastening member 1; a bolt 22 held in the recess chamber 12 in the male fastening member for rotatably mounting the plurality of dials 3 and sleeves 4 on the bolt 22 in the recess chamber 12 and depressible by the biasing button 21 when biasing the biasing button 21; and a latch portion 23 rotatably held in the latch guide 16 adapted to be insertable and engageable in a latch sleeve 52 formed in the female fastening member 5.

The biasing button 21 includes: an arcuate plate 211 slidably held in an arcuate groove formed in the male cover 11 of the male fastening member 1, a thin arm portion 212 formed on a first end portion of the arcuate plate 211, a thick arm portion 213 formed on a second end portion of the arcuate plate 211 opposite to the thin arm portion 212, with each said arm portion 212, 213 selectively engageable with a bolt head portion 222 of the bolt 22, and a stem 214 perpendicularly protruding from the arcuate plate 211 for rotatably driving the latch portion 23 for engaging with or disengaging from the female fastening member 5 when biasing the biasing button 21.

Figure 3:
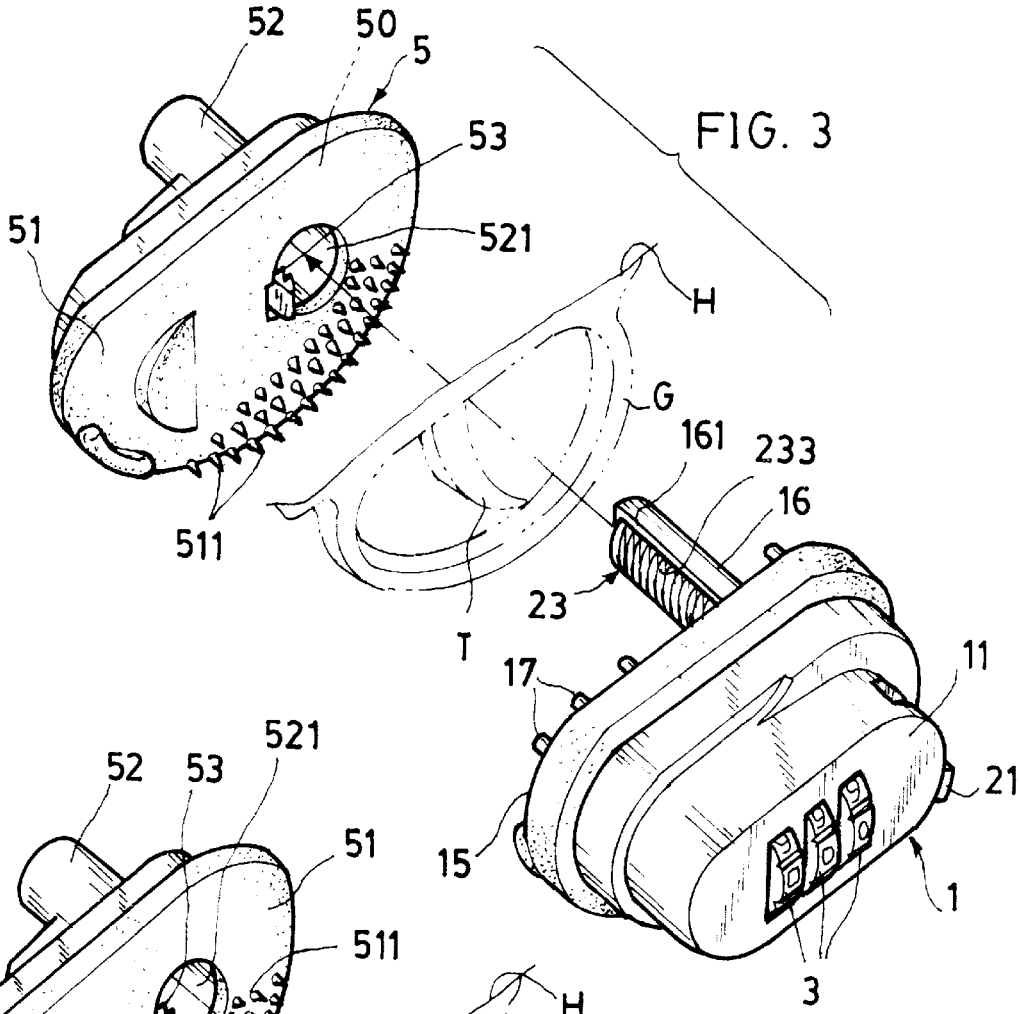
FIG. 3 is a perspective view showing two fastening members of the present invention adapted for locking the trigger guard of a firearm.
Figure 4:
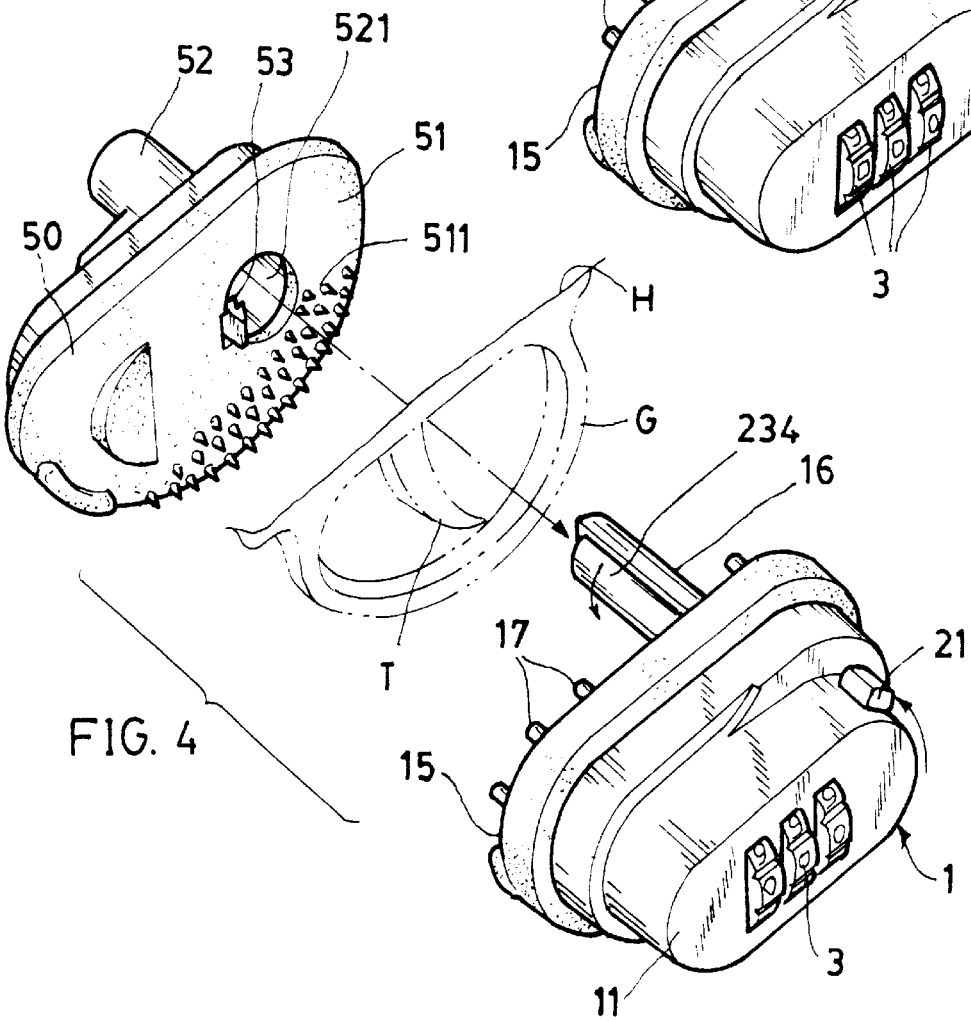
FIG. 4 shows the two fastening members for unlocking the trigger guard.
Figure 5:
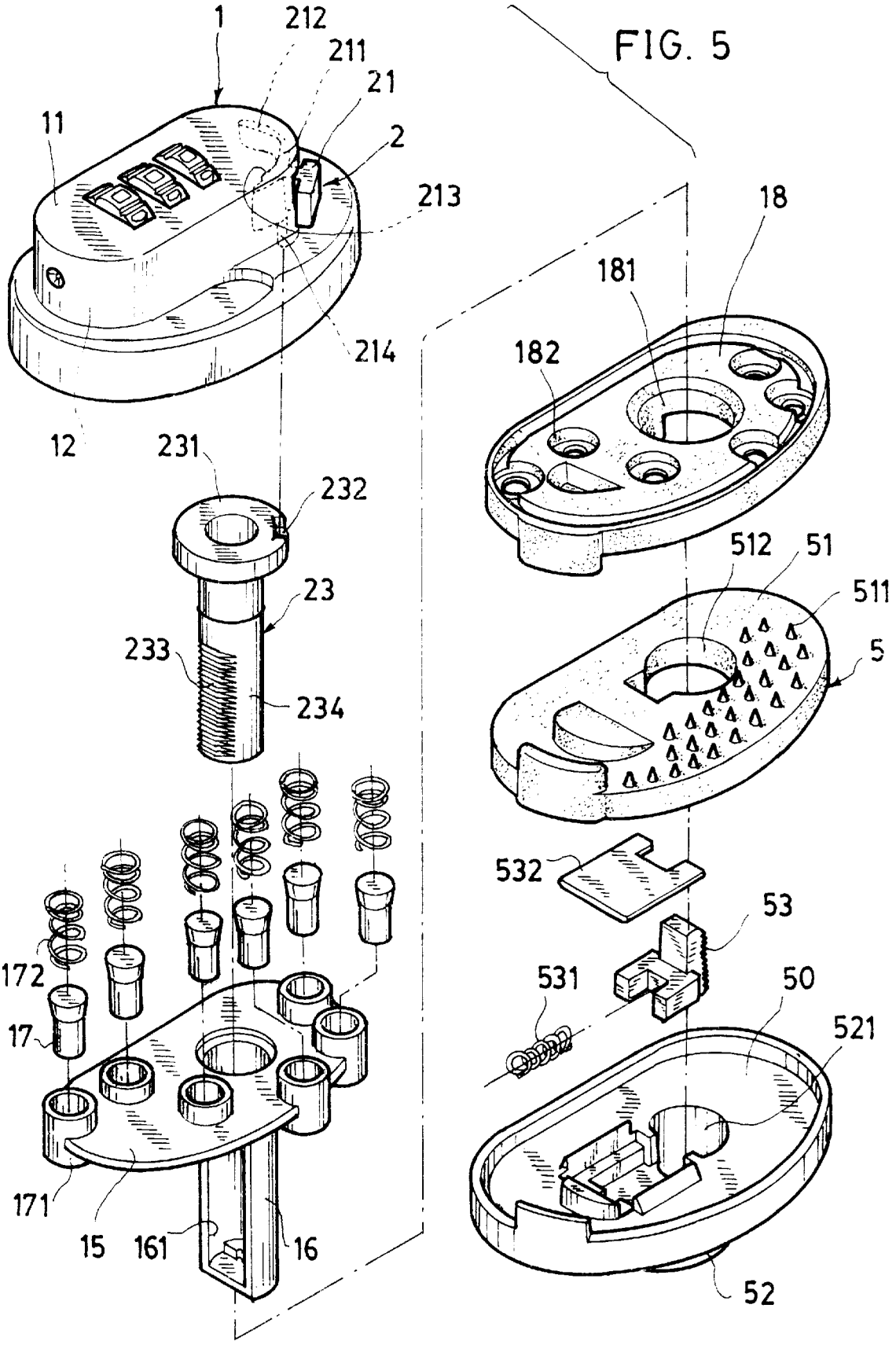
FIG. 5 is an exploded view of the elements in construction of the present invention.

The latch portion 23 (FIG. 5) includes: a driving disk 231 formed on a base portion of the latch portion 23 having a notch 232 formed in the driving disk 231 to be engaged with the stem 214 of the biasing button 21, a plurality of ratchet teeth 233 formed on the latch portion 23 for engaging (FIG. 3) a ratchet catch 53 resiliently mounted in the female fastening member 5, and a smooth cylindrical surface 234 formed on the latch portion 23 juxtapositional and adjacent to the ratchet teeth 233 for disengaging the latch portion 233 from the ratchet catch 53 (FIG. 4).

Each dial 3 is formed with arabic number 0, 1, 2 . . . 9 on an annular ring 31 of each dial 3 and formed with a plurality of teeth 32 in an inner surface of the annular ring 31 to be engageable with a plurality of teeth 41 circumferentially formed on an outside cylindrical surface of each sleeve 4 for a synchronous rotation of the dial 3 as coupled with the sleeve 4.

Each sleeve 4 includes: a plurality of teeth 41 engageable with the teeth 32 annularly formed in each dial 3, an annular extension 42 formed in a central portion of each sleeve 4 for retarding each projection 221 formed on the bolt 22 of the control device 2 when the locking mechanism is locked, a through slot 43 longitudinally notched in the annular extension 42 for passing the projection 221 of bolt 22 when unlocked, and a central hole 44 formed in the central portion of the annular extension 42 for engaging the bolt 22.

The bolt 22 further includes a restoring spring 223 jacketed on the bolt 22 and retained between the bolt head 222 and one innermost sleeve 4 for resiliently urging the sleeves 4 to be engaged with the dials 3 for a coupling rotation of each dial 3 with each sleeve 4.

The female fastening member 5 includes: a female cover 50 corresponding to the male cover 11, a latch sleeve 52 having a sleeve hole 521 formed in the female cover 50 for inserting the latch guide 16 carrying the latch portion 23 of the control device 2 in the sleeve hole 521 in the latch sleeve 52, a ratchet catch 53 resiliently held in the female cover 50 by a tension spring 531, which is retained in a spring socket recessed in the female cover 50 and covered by a catch cover 532, to be protruded into the sleeve hole 521 to allow a plurality of ratchet teeth formed on the catch 53 for engaging the ratchet teeth 233 formed on the latch portion 23 for locking the male fastening member 1 with the female fastening member 5, and a packing cap 51 made of rubber encasing the female cover 50 and having a plurality of protrusions 511 protruding outwardly from the packing cap 51 and a latch hole 512 formed in the cap 51 for passing the latch portion 23 into the latch sleeve 52, with the protrusions 511 of the female fastening member 5 cooperated with the beads 17 resiliently held in the male fastening member 1 for cooperatively frictionally embracing and clamping the trigger guard G and the trigger T of the firearm H for locking the male and female fastening members 1, 5.

The combination changing means 6 includes: a short cylinder 61 having a bolt recess 62 recessed in the short cylinder 61 and engageable with a bolt end 224 of the bolt 22, an impinging stem 63 protruding outwardly from the short cylinder 61 through a stem hole 113 formed in the male cover 11 towards an outside surface of the male cover 11, and a protuberance portion 64 formed on the short cylinder 61 and selectively engageable with an outer notch 114 formed in the male cover 11 adjacent to the outside surface of the male cover 11 and engageable with an inner notch 115 formed in the male cover 11 adjacent to the sleeves 4; whereby upon an inward depression of the impinging stem 63 by an external tool such as a pin to allow the short cylinder 61 to push the sleeves 4 to be disengaged from the dials 3 when the locking mechanism (3,4) is unlocked and the bolt head 222 is engaged with the thin arm portion 212 of the biasing button 21 as shown in FIG. 9, the dials 3 are then free rotated for resetting a new combination.

Figure 8:
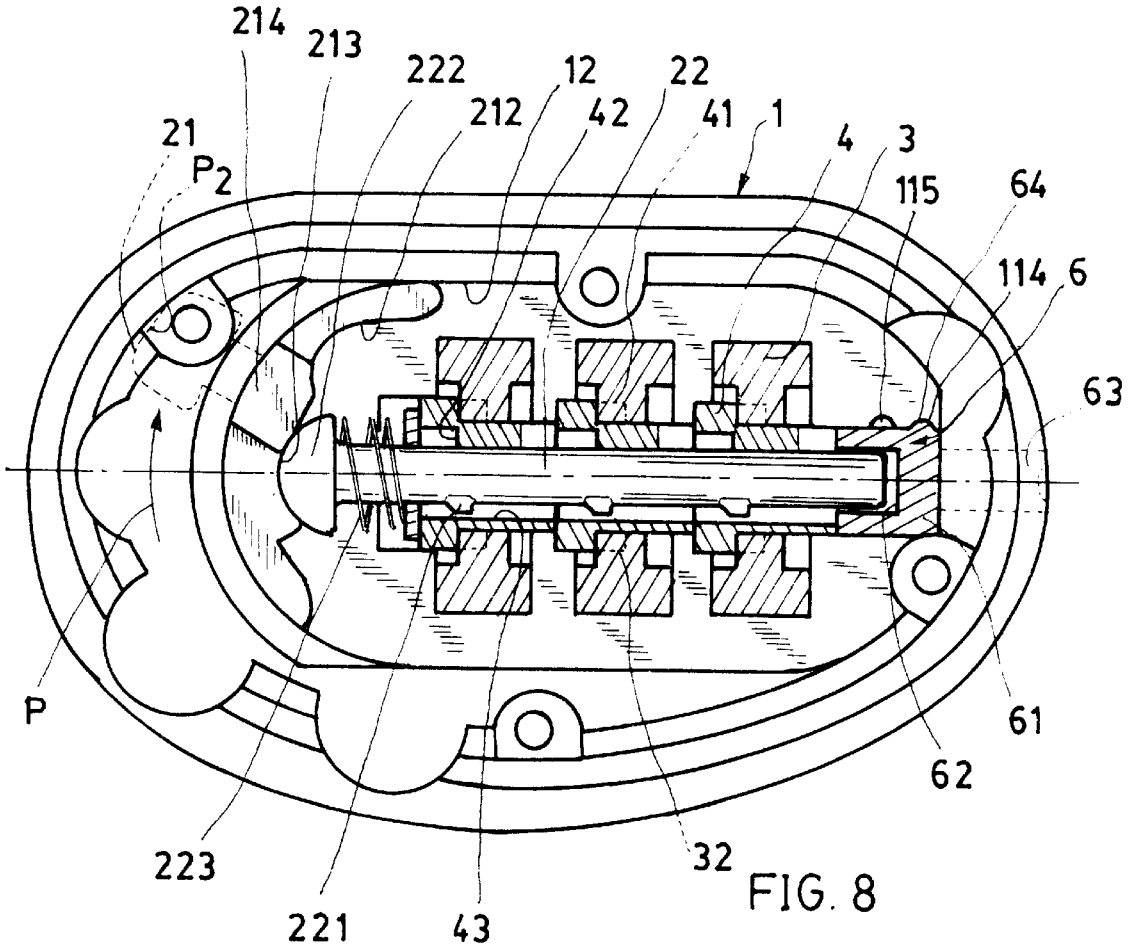
FIG. 8 shows an unlocked state of the present invention adapted for unlocking the two fastening members.

For locking a trigger T of a firearm such as a handgun H, the biasing button 21 is moved to a first position P1 on the male fastening member 1 as shown in dotted line of FIG. 7 to allow the bolt head 222 to be engaged with the thin arm portion 212 of the arcuate plate 211 of the biasing button 21, and the dials 3 are rotated to drive the sleeves 4 to allow the annular extension 42 (dotted line of FIG. 7) of at least one sleeve 4 to retard the projection 221 formed on the bolt 22, whereby upon a trial moving of the biasing button 21 from its first position P1 (FIG. 7) to a second position P2 as dotted line shown in FIG. 8, the bolt projections 221 are retarded by the sleeve extensions 42, thereby preventing the biasing movement of the biasing button 21 from the first position P1 to the second position P2. By the way, the ratchet teeth 233 of the latch portion 23 are still engaged with the ratchet catch 53 for stably locking the male fastening member 1 and the female fastening member 5. The closer the two fastening members 1, 5 are pressed together, the ratchet teeth 233 and the ratchet catch 53 are deeply engaged in one-way direction to firmly embrace, clamp and lock the trigger guard G and the trigger T of the gun H in between the two fastening members 1, 5 for safely locking the gun H. The protrusions 511 and the beads 17 of the two fastening members 5, 1 may further frictionally tightly fasten the trigger T and the guard G without vibration or loosening.

For unlocking the trigger T of the gun H by dialing the correct opening combination of the dials 3 to align the through slot 43 of each sleeve 4 with the projections 221 longitudinally formed on the bolt 22, and the biasing button 21 is shifted from the first position P1 (FIG. 7) towards the second position P2 (FIG. 8) to allow the thick arm portion 213 of the button 21 to rightwardly push the bolt head 222 and the bolt 2 which is rightwardly retractable since the projections 221 may be pushed into the slots 43 of the sleeves 4 without being retarded. Simultaneously the latch portion 23 is rotated since the stem 214 of the button 21 is engaged with the notch 232 of the latch portion 23 (FIG. 5) to disengage the ratchet teeth 233 on the latch portion 23 from the ratchet catch 53. Therefore, the smooth cylindrical surface 234 on the latch portion 23 will be slid from the resilient ratchet catch 53 to unlock and separate the male fastening member 1 from the female fastening member 5 for unlocking the firearm H.

The combination can be reset or changed when the locking mechanism (3,4) is unlocked as shown in FIG. 9 by inwardly depressing the impinging stem 63 and the short cylinder 61 to disengage the sleeves 4 from the dials 3 for free rotation of the dials 3. Meanwhile, the bolt recess 63 of the short cylinder 61 has also been leftwardly pushed to be contiguous to the bolt end 224 of the bolt 22; whereby upon a rightward depression of the bolt head 222 when pushing (P) the biasing button 21 to allow the thick arm portion 213 of the button 21 to engage and depress the bolt head 222 (FIG. 8), the restoring spring 223 as urged by the bolt head 222 will force the sleeves 4 to restore the short cylinder 61 of the combination changing means 6 by engaging the protuberance portion 64 with the outer notch 114 of the male cover 11 for rightwardly extending the impinging stem 63 outwardly ready for a next depression.

The present invention is superior to the conventional firearm lock with the following advantages:

1. Just by shifting the biasing button 21 from a locking position (P1) to an unlocking position (P2), the button 21 will be stably rested there and the latch portion 23 will be unlocked and withdrawn from the latch sleeve 52 to easily unlock and separate the male fastening member 1 from the female fastening member 5 without continuously depressing the button. Therefore, the present invention can be unlocked more ergonomically and conveniently. Also, the unlocking time can be shortened for a quick response when it is necessary to use the gun for an emergency security reason.

2. The button 21 of this invention is not always depressed to prevent tiredness for the user. However, in view of the prior art of U.S. Pat. No. 4,499,681, the push button 36 should be continuously depressed, when unlocked, to disengage the ratchet teeth 26 from the teeth 30 of the latching portion 54 in order for overcoming the spring force of the spring 63, easily causing tiredness for the user.

The present invention may be modified without departing from the spirit and scope of this invention.

I claim:

1. A firearm lock comprising:

a male fastening member having a latch portion formed thereon;

a female fastening member corresponding to said male fastening member and having a latch sleeve formed in said female fastening member, whereby upon disposing of said male fastening member and said female fastening member on opposite sides of a trigger and trigger guard of a firearm, said latch portion of said male fastening member is passed through said trigger guard to be inserted and engaged into said latch sleeve in said female fastening member for embracing and clamping said trigger guard in between said two fastening members;

a control device having a biasing button and securable to said male fastening member; said biasing button operatively shifted to a first position on said male fastening member for controlling a locking of said latch portion in said latch sleeve for locking said male fastening member and said female fastening member on opposite sides of said trigger guard; and said biasing button operatively shifted to a second position on said male fastening member for controlling an unlocking of said latch portion from said latch sleeve for unlocking and separating said male fastening member from said female fastening member; and a locking mechanism formed in said male fastening member, said locking mechanism operatively locking said control device for preventing a movement of said biasing button from said first position on said male fastening member towards said second position n said male fastening member for ensuring locking of said latch portion in said latch sleeve; and said locking mechanism operatively unlocking said control device for allowing a movement of said biasing button from said first position to said second position on said male fastening member for unlocking said latch portion from said latch sleeve;

said locking mechanism being a combination lock consisting of a plurality of dials and sleeves; and said male fastening member including: a male cover having a recess chamber formed in the male cover for mounting the control device, the dials and the sleeves in the recess chamber, and a holding base sealing a bottom portion of the male cover and having a latch guide protruding from the holding base for inserting said latch portion within the latch guide having an elongate opening for revealing the latch portion outwardly through the elongate opening to be engaged in said latch sleeve of said female fastening member;

said control device including: said biasing button slidably held in a button hole formed in the male cover of the male fastening member; a bolt held in the recess chamber in the male fastening member for rotatable mounting the plurality of dials and sleeves of the locking mechanism on the bolt and in the recess chamber and depressible by the biasing button when biasing the biasing button;

and said latch portion rotatably held in the latch guide adapted to be insertable and engageable in said latch sleeve formed in the female fastening member; and said biasing button including: an arcuate plate slidably held in an arcuate groove formed in the male cover of the male fastening member, a thin arm portion formed on a first end portion of the arcuate plate, a thick arm portion formed on a second end portion of the arcuate plate opposite to the thin arm portion, with each said arm portion selectively engageable with a bolt head portion of the bolt, and a stem perpendicularly protruding from the arcuate plate for rotatably driving the latch portion for engaging with and disengaging from the female fastening member when biasing the biasing button.

2. A firearm lock according to claim 1, wherein said holding base has a plurality of beads respectively resiliently held in a plurality of cylinders formed on the holding base by a plurality of tension springs, and a bottom packing secured on a bottom surface of the holding base having a guide hole for passing the latch guide and a plurality of cylinder holes for passing and protruding the beads outwardly beyond the cylinders.

3. A firearm lock according to claim 1, wherein said latch portion includes: a driving disk formed on a base portion of the latch portion having a notch formed in the driving disk to be engaged with the stem of the biasing button, a plurality of ratchet teeth formed on the latch portion for engaging a ratchet catch resiliently mounted in the female fastening member, and a smooth cylindrical surface formed on the latch portion juxtapositional and adjacent to the ratchet teeth for disengaging the latch portion on said male fastening member from the ratchet catch.

4. A firearm lock according to claim 3, wherein said female fastening member includes: a female cover corresponding to a male cover of said male fastening member, a latch sleeve having a sleeve hole formed in the female cover for inserting a latch guide carrying the latch portion in the sleeve hole in the latch sleeve, the ratchet catch having a plurality of ratchet teeth formed on the catch for engaging the ratchet teeth formed on the latch portion for locking the male fastening member with the female fastening member, and a packing cap encasing the female cover.

5. A firearm lock according to claim 1, wherein said male fastening member is formed with a combination changing means therein, said combination changing means including: a short cylinder having a bolt recess recessed in the short cylinder and engageable with a bolt end of the bolt, an impinging stem protruding outwardly from the short cylinder through a stem hole formed in the male cover, and a protuberance portion formed on the short cylinder and selectively engageable with an outer notch formed in the male cover adjacent to the outside surface of the male cover and engageable with an inner notch formed in the male cover adjacent to the sleeves; whereby upon an inward depression of the impinging stem by an external tool to allow the short cylinder to push the sleeves to be disengaged from the dials when the locking mechanism is unlocked, the dials are rotatable for resetting a new combination.

* * * * *